US011643929B2

(12) United States Patent
Harrigan

(10) Patent No.: US 11,643,929 B2
(45) Date of Patent: May 9, 2023

(54) DOWNHOLE TOOL INCLUDING A HELICALLY WOUND STRUCTURE

(71) Applicant: Halliburton Energy Services, Inc., Houston, TX (US)

(72) Inventor: Edward Harrigan, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 252 days.

(21) Appl. No.: 16/791,706

(22) Filed: Feb. 14, 2020

(65) Prior Publication Data

US 2021/0254460 A1 Aug. 19, 2021

(51) Int. Cl.

| | |
|---|---|
| ***E21B 49/10*** | (2006.01) |
| ***E21B 33/128*** | (2006.01) |
| ***E21B 23/01*** | (2006.01) |
| ***E21B 17/10*** | (2006.01) |

(52) U.S. Cl.

CPC ..... *E21B 49/10* (2013.01); *E21B 17/1014* (2013.01); *E21B 23/01* (2013.01); *E21B 33/128* (2013.01)

(58) Field of Classification Search

CPC ..... E21B 49/10; E21B 17/1014; E21B 23/01; E21B 33/128

See application file for complete search history.

(56) References Cited

U.S. PATENT DOCUMENTS

| | | | | |
|---|---|---|---|---|
| 4,515,213 | A * | 5/1985 | Rogen | E21B 36/00 166/134 |
| 7,699,124 | B2 | 4/2010 | Corre et al. | |
| 7,849,928 | B2 | 12/2010 | Collie | |
| 8,091,634 | B2 | 1/2012 | Corre et al. | |
| 9,097,107 | B2 | 8/2015 | Corre et al. | |
| 9,422,811 | B2 | 8/2016 | Bedouet et al. | |
| 2011/0067860 | A1 | 3/2011 | Corre et al. | |
| 2015/0176375 | A1 | 6/2015 | Bedouet et al. | |
| 2016/0053612 | A1 | 2/2016 | Proett et al. | |

FOREIGN PATENT DOCUMENTS

| | | |
|---|---|---|
| EP | 2340350 B1 | 9/2016 |

* cited by examiner

*Primary Examiner* — Yong-Suk (Philip) Ro

(74) *Attorney, Agent, or Firm* — John Wustenberg; Parker Justiss, P.C.

(57) ABSTRACT

Provided, in one aspect, is a downhole tool. The downhole tool, according to this aspect, may include a helically wound structure having first and second ends, as well as a first member coupled to the first end and a second member coupled to the second end. In accordance with this aspect, the first and second members are rotatable or linearly translatable with respect to each other to move the helically wound structure between a radially retracted state having at least one coils and a radially deployed state.

20 Claims, 7 Drawing Sheets

DOWNHOLE TOOL INCLUDING A HELICALLY WOUND STRUCTURE

BACKGROUND

In the search for hydrocarbon bearing subterranean formations, a well may be drilled and tested prior to completion and/or production. To determine properties and evaluate a subterranean formation after the wellbore is drilled, oilfield service companies offer a multitude of tools and techniques. For example, downhole tools may be suspended in the wellbore by a downhole conveyance. Such a downhole conveyance may further provide support for the downhole tool, such as associated power, control and communication with the surface, among others.

One question often sought to be resolved with such downhole tools concerns the fluid hydrocarbon content of selected formations. Fluid sampling tools offer the opportunity to capture fluid samples directly from the subterranean formation and isolate them for analysis in-situ or when the downhole tool returns to the surface. Such a fluid sampling tool generally operates by pressing a sealing probe against a portion of the wellbore wall and, through the use of a controlled reduction of pressure, drawing fluid from the surrounding subterranean formation. However, in some situations, the fluid sampling tool's pressure drawdown can cause the target fluid to change in composition (e.g., for gases or solids to separate from the fluid), and in poorly consolidated formations, the formation may crumble, yielding sand or other small particulates along with the formation fluid, leading to a loss of seal or to clogging and failure of the probe or internal flow lines and valve mechanisms.

Recognizing these hazards, the industry has attempted various solutions including the use of multiple probes, probes with enlarged flow areas, screen filters, pumps with fine pressure and flowrate control, downhole sensors to detect the onset of these problems and designing tool internals to be robust to the presence of solids in the sample. Yet sampling limitations still occur in some cases and improved tool performance is sought, particularly in low permeability and poorly consolidated formations, where the fluid to be sampled is susceptible to changes in composition when subjected to a pressure drawdown or where the formation itself is susceptible to yielding.

BRIEF DESCRIPTION

Reference is now made to the following descriptions taken in conjunction with the accompanying drawings, in which.

DETAILED DESCRIPTION

Figure 1:
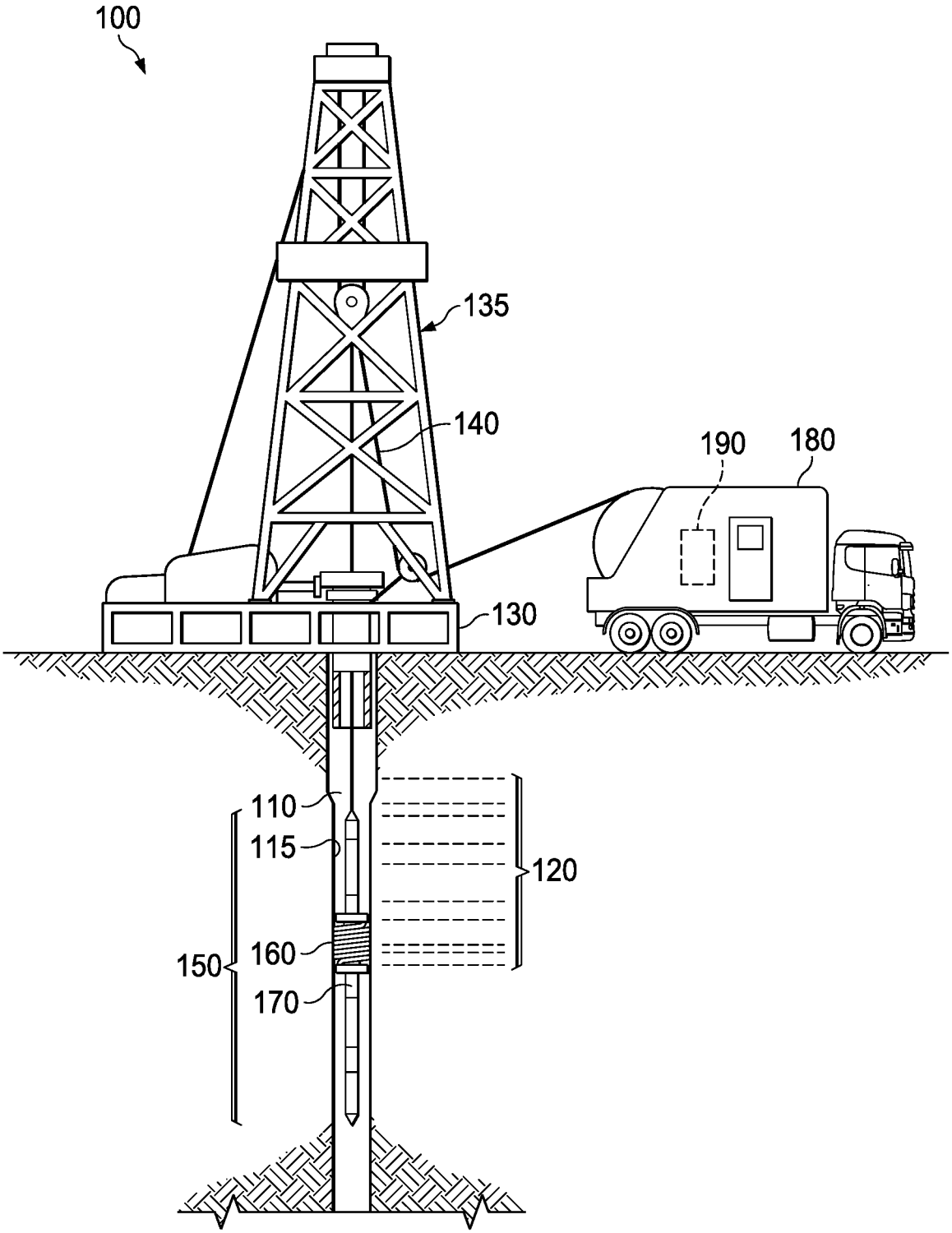
FIG. 1 illustrates a perspective view of a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring to FIG. 1, depicted is a perspective view of a well system 100 including an exemplary operating environment that the apparatuses, systems and methods disclosed herein may be employed. In FIG. 1, a wellbore 110 has been drilled through various subterranean formations 120. In certain embodiments, the wellbore 110 is an uncased wellbore, such as shown in FIG. 1. In other embodiments, however, the wellbore 110 is partially cased or fully cased, neither of which are shown in FIG. 1. Accordingly, unless otherwise required, the present disclosure should not be limited to an uncased, partially cased or fully cased wellbore 110. Located within the wellbore 110 is a wellbore wall 115. The type of wellbore wall 115 may vary greatly and remain within the scope of the disclosure. For example the type of wellbore wall 115 may vary depending on the type of wellbore 110 (e.g., uncased, partially cased, fully cased), degree of completion of the well system 100 (e.g., including production tubing therein), etc. For instance, the wellbore wall 115 could be the subterranean formation itself, a cased portion of the wellbore 110, production tubing, or another downhole wellbore wall.

In the well system 100, a drilling platform 130 supports a derrick 135 capable of raising and lowering a downhole conveyance 140 and tool string 150 within the wellbore 110. While the downhole conveyance 140 is illustrated in FIG. 1 as a wireline, other types of downhole conveyance, including slickline, coiled tubing, pipe conveyed wireline, work string, etc., could be also used, and are thus within the purview of the disclosure.

The tool string 150 illustrated in FIG. 1 includes a downhole tool 160 designed, manufactured, and operated according to the present disclosure. The downhole tool 160, in accordance with one or more embodiments of the disclosure, may include a helically wound structure including at least one coil in the radially retracted state and having first and second ends. The downhole tool 160 may additionally include a first member coupled to the first end and a second member coupled to the second end. In accordance with this embodiment, the first and second members may rotate or linearly translate with respect to each other to move the helically wound structure between the radially retracted state and a radially deployed state in contact with the wellbore wall 115, such as shown in FIG. 1.

In accordance with one or more embodiments, the downhole tool 160 can be designed, manufactured and operated as a downhole anchor. According to this embodiment, the downhole anchor could be used to anchor, and subsequently release, many different downhole devices within the wellbore 110. In other embodiment, the downhole tool 160 can be designed, manufactured and operates as a downhole centralizer. For example, the downhole centralizer could be used to center, and subsequently release, many different downhole devices within the wellbore 110. In further embodiments, the downhole tool 160 can be designed, manufactured and operated as a downhole packer. For example, the downhole packer could seal or otherwise isolate a region of the wellbore 110. In even yet another embodiment, the downhole tool 160 can be designed, manufactured and operated as a fluid sampling tool. For example, the fluid sampling tool could radially deploy to sample fluids from within the wellbore 110 and particularly from a wellbore wall 115 in the wellbore 110. The tool string 150 illustrated in FIG. 1, in one or more embodiments, additionally includes a telemetry sub 170. Notwithstanding, additional tools may also be included with the tool string 150, such as logging tools, pumps, fluid analyzers, storage chambers, and packers, MWD tools, and LWD tools, among others.

In one or more embodiments wherein the downhole tool 160 is a fluid sampling tool, the helically wound structure of the fluid sampling tool is capable of moving to a radially deployed state to receive a formation fluid, whereby measurements of the formation fluid may be analyzed, for example, by either the fluid sampling tool or other tools in direct or indirect contact with the tool string 150. Such measurements may be stored in internal memory of the telemetry sub 170, among other locations. Alternatively, the measurements may be communicated to the surface via a communications link. A computing or logging facility 180, which may include a computer system 190, may be arranged at the surface to receive such communications. The logging facility 180 may be configured to manage tool string 150 operations, acquire and store the measurements, and process the measurements for display to an operator.

Figure 2A:
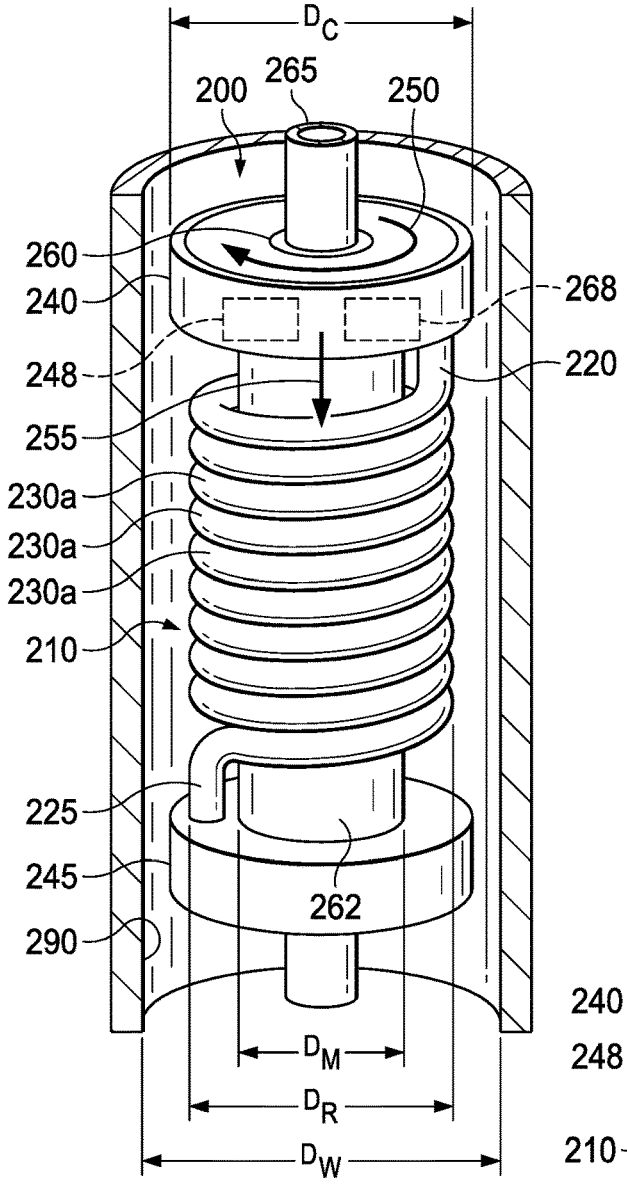
FIGS. 2A and 2B illustrate perspective views of a downhole tool designed and manufactured according to one or more embodiments of the disclosure.
Figure 2B:
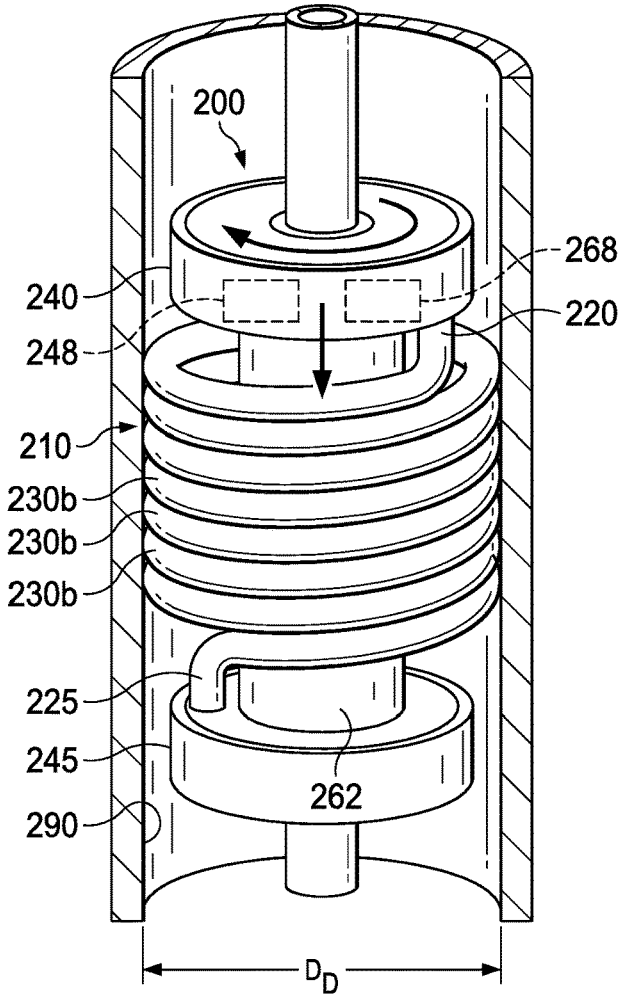

FIGS. 2A and 2B illustrate perspective views of a downhole tool 200 designed and manufactured according to one or more embodiments of the disclosure. The downhole tool 200, in one or more embodiments, could be used as the downhole tool 160 used in FIG. 1 above. FIG. 2A illustrates the downhole tool 200 positioned in a radially retracted state within a wellbore wall 290. The wellbore wall 290 illustrated in FIGS. 2A and 2B, in one or more embodiments, is similar to the wellbore wall 115 illustrated in FIG. 1. In contrast, FIG. 2B illustrates the downhole tool 200 positioned in a radially deployed state within the wellbore wall 290. The wellbore wall 290 may be an openhole portion of a wellbore (e.g., in which case the downhole tool 200 would engage the subterranean formation itself), a cased portion of a wellbore (e.g., in which case the downhole tool 200 would engage the wellbore casing), or alternatively production tubing (e.g., in which case the downhole tool 200 would engage the production tubing), among others. Notwithstanding, in the embodiment depicted in FIGS. 2A and 2B, the wellbore wall 290 is wellbore casing, and thus the downhole tool 200 would engage the wellbore casing.

With reference to FIG. 2A, the downhole tool 200 includes a helically wound structure 210 having a first end 220 and a second end 225. The helically wound structure 210 can include at least one coil 230*a* in the radially retracted state illustrated in FIG. 2A. The term "coil", as used herein, means a complete 360-degree revolution back upon itself. Thus, the helically wound structure 210, in the radially retracted state, can include one or more complete 360-degree revolutions back upon itself. In other embodiments, the helically wound structure 210 could include at least three coils in the radially retracted state. At least three coils provide significantly more coverage than when only a single coil is used. In yet other embodiments, the helically wound structure 210 might include at least five coils in the radially retracted state, and in further embodiments, the helically wound structure 210 might include anywhere from eight to twenty (or more) coils in the radially retracted state.

The coils 230*a* of the helically wound structure 210 are illustrated in FIG. 2A as being in direct contact with their adjacent coils 230*a*, and thus no space separates the adjacent coils 230*a* of the helically wound structure 210. Such may be important when the downhole tool 200 is designed and operated as a downhole packer, as it may prevent fluid from travelling in a spiral fashion between the adjacent coils 230*a*. Nevertheless, other embodiments may exist wherein a space is intentionally left between adjacent coils 230*a*. Accordingly, unless otherwise required, the present disclosure should not be limited to situations with, or without, spacing between adjacent coils 230*a*.

The helically wound structure 210, as illustrated in FIG. 2A, may have a retracted diameter ($D_R$) when in the radially retracted state. The retracted diameter ($D_R$) may vary based upon the design and/or use of the downhole tool 200. For example, in cased hole applications the retracted diameter ($D_R$) is typically less than 180 mm (e.g., approximately 7 inches), and typically greater than 43 mm (e.g., approximately 1 11/16 inches). In one or more embodiments of a cased hole application, the retracted diameter ($D_R$) ranges from 75 mm (e.g., approximately 3 inches) to 150 mm (e.g., approximately 6 inches). In open hole applications, the retracted diameter ($D_R$) can be less than 305 mm (e.g., approximately 12 inches), and can be greater than 75 mm (e.g., approximately 3 inches). In one or more embodiment of an open hole application, the retracted diameter ($D_R$) ranges from 102 mm (e.g., approximately 4 inches) to 229 mm (e.g., approximately 9 inches). Notwithstanding the foregoing values, unless otherwise stated the present disclosure should not be limited to any specific value.

In the illustrated embodiment of FIG. 2A, the first end 220 of the helically wound structure 210 is coupled to a first member 240, and the second end 225 of the helically wound structure 210 is coupled to a second member 245. The first and second members 240, 245 are illustrated as cylindrical members having a diameter (Dc), which by nature would need to be less than a diameter ($D_W$) of the wellbore wall 290. In one or more embodiments, the diameter ($D_C$) ranges from 70 percent to 90 percent of the diameter ($D_W$) of the wellbore wall 290, but other diameters (Dc) are within the scope of the disclosure. Notwithstanding the above, other sizes and shapes for the first and second members 240, 245 are within the scope of the disclosure.

The first member 240 and the second member 245 can be rotatable (e.g., as shown by arrow 250) and/or linearly translatable (e.g., as shown by arrow 255) with respect to each other to move the helically wound structure 210 between the radially retracted state, as shown in FIG. 2A, and the radially deployed state, as shown in FIG. 2B. The first member 240 can be both rotatable and translatable with respect to the second member 245, which is fixed (e.g., at least momentarily) in both rotation and translation within the wellbore wall 290. Such may be useful when the first member 240 is an uphole member, and the second member 245 is a downhole member. In yet other embodiments, the first member 240 is fixed (e.g., at least momentarily) in both rotation and translation within the wellbore wall 290, while the second member 245 is rotatable and/or translatable with respect to the fixed first member 240. Notwithstanding the above, any combination of rotation and/or translation of each of the first member 240 and second member 245 with respect to each other is within the scope of the present disclosure.

The first and/or second members 240, 245 may include one or more different mechanisms for rotation and/or translation. For example, the first member 240 includes a motor 248 to provide the requisite rotation and translation relative to the second fixed member 245. In other examples, an electric motor, a fluid motor, or a mechanical motor, among others, could be included within or attached to the first member 240 for providing the requisite rotation, with a spline shaft allowing one end of the mechanism to translate freely as torque is applied from the motor to the mechanism. Alternatively, a piston or linear actuator could provide a translation force, with a swivel mechanism providing free rotation. Either one or both of the first and second members 240, 245 may include a motor 248 for rotation and/or translation.

As depicted in FIG. 2A, the first member 240 and/or second member 245 may additionally include a seal 260. The seal 260 may be a rotary seal or dynamic (e.g., linear) seal, depending on the design of the downhole tool 200. A rotary seal is particularly useful when the downhole tool 200 is being used for fluid sampling, such is the case when the helically wound structure 210 is a hollow tube. The rotary seal, in this embodiment, allows the first member 240 (e.g., in the embodiment of FIGS. 2A and 2B) to rotate relative to a (e.g., non-rotating) downhole conveyance 265, or another non-rotating member coupled thereto. Those skilled in the art understand the purpose for, and various different designs of, the seal 260 (e.g., rotary or dynamic), such as for fluid sampling applications.

In the embodiment of FIG. 2A, the downhole tool 200 includes a mandrel 262, for example coupled between the first and second members 240, 245 and positioned within an internal diameter created by the coils 230*a*. The mandrel 262, in one or more embodiments, may be a hollow mandrel (e.g., hollow metal mandrel), such as shown in FIG. 2A. The hollow mandrel may be used to allow additional downhole features, including cables, wires, fluid lines, and the like, to extend there through and thus further downhole when the downhole tool 200 is in use. For example, the hollow mandrel could be configured to accept fluid and/or electrical lines there through. The mandrel 262 may provide tensile strength to convey and connect heavy tools below the mechanism to tools above the mechanism. The mandrel 262 may additionally be used to provide support for the helically wound structure 210 when it is in the radially retracted state, for example as it is being deployed downhole. In accordance with this embodiment, an outer diameter ($D_M$) of the mandrel 262 could be chosen to assist in controlling the retracted diameter ($D_R$) of the helically wound structure 210. The inner diameter (and material) of the mandrel 262 would be chosen to provide enough space for the thru wires and flow lines and to provide mechanical strength to support wireline tools below.

FIG. 2B illustrates the downhole tool 200 in the radially deployed state, for example after rotating or translating the first and second members 240, 245 with respect to each other in a first direction to move the helically wound structure 210 from the radially retracted state to a radially deployed state in contact with a wellbore wall 290. In the radially deployed state, the helically wound structure 210 engages the wellbore wall 290. The first and second members 240, 245 may be rotated or translated with respect to each other in a second opposite direction to move the helically wound structure 210 from the radially deployed state back to the radially retracted state.

The helically wound structure 210, in the radially deployed state illustrated in FIG. 2B, includes two or more coils 230*b*. In other embodiments, the helically wound structure 210 might include at least four coils 230*b* in the radially deployed state. In yet other embodiments, the helically wound structure 210 might include anywhere from six to eighteen (or more) coils 230*b* in the radially deployed state.

The helically wound structure 210, as illustrated in FIG. 2B, may have a deployed diameter ($D_D$) when in the radially deployed state. The deployed diameter ($D_D$) may vary based upon the use of the downhole tool 200, and the diameter ($D_W$) of the wellbore wall 290, as well as if the wellbore wall 290 is a cased hole or open hole application. For example, in one or more embodiments, the helically wound structure 210 may expand up to 20 percent in diameter when moving from the radially retraced state to the radially deployed state. In accordance with one or more other embodiments, the helically wound structure 210 may expand up to 50 percent in diameter when moving from the radially retraced state to the radially deployed state, and in yet other embodiments up to 100 percent or more in diameter. In accordance with one or more of the above expansion values, in a cased hole application the deployed diameter ($D_D$) may range from 47 mm (e.g., approximately 1⅞ inches to 230 mm (e.g., approximately 9 inches). In one or more other embodiments of a cased hole application, the deployed diameter ($D_D$) ranges from 102 mm (e.g., approximately 4 inches) to 178 mm (e.g., approximately 7 inches). In one or more open hole applications, the deployed diameter ($D_D$) may range from 150 mm (e.g., approximately 6 inches) to 406 mm (e.g., approximately 16 inches). In one or more other embodiments of an open hole application, the deployed diameter ($D_D$) ranges from 203 mm (e.g., approximately 8 inches) to 305 mm (e.g., approximately 12 inches). Notwithstanding the foregoing values, unless otherwise stated the present disclosure should not be limited to any specific value.

Nevertheless, the number of coil turns and the expansion ratio will depend on the application. If the application is tool anchoring or centralization, then a high number of turns and a small expansion ratio is more likely. If the downhole tool 200 has to pass through production tubing and then expand in a larger diameter casing below, then a large expansion ratio is more likely. If the application is fluid sampling, then the compressive strength of the helically wound structure 210 must be chosen so as to apply adequate compressive force against the formation wall when deployed to energize the elastomer and obtain a seal. This all affects material choices and diameter of the helically wound structure 210 and supporting mechanical parts. In one or more embodiments, the helically wound structure 210 will be in mechanical tension when retracted and in mechanical compression when deployed.

As illustrated in FIG. 2B, the downhole tool 200 may include a fixing member 268 to keep the helically wound structure 210 in the radially deployed state. The fixing member 268, in one or more embodiments, is a mechanical or electric brake, among other types of fixing members. In one or more other embodiment, the fixing member 268 is a ratchet mechanism, j-slot mechanism, a mechanical thread, a mechanical latch mechanism or another type of fixing member 268 in accordance with the disclosure. In yet other embodiments, the helically wound structure 210 is moved to the radially deployed state using a hydraulic system, and the fixing member 268 is a valve.

The helically wound structure 210 may, in certain embodiments, include a naturally wound state and a modified wound state. The naturally wound state of the helically wound structure 210 is that state that the helically wound structure 210 would return to if the first or second members 240, 245 were not to be imparting rotation or translation thereto. The modified wound state of the helically wound structure 210 is the one or more states that the helically wound structure 210 might achieve when the first and second members 240, 245 impart the rotation or translation thereto. In certain embodiments, the helically wound structure 210 is in the naturally wound state when in the radially retracted state, and in the modified wound state when in the radially deployed state. In other embodiments, the helically wound structure 210 is in the modified wound state when in the radially retracted state, and in the naturally wound state when in the radially deployed state. In yet other embodiments, the helically wound structure 210 is in a first modified wound state when in the radially retracted state and in a second modified wound state when in the radially deployed state. Such different configurations may be employed to assist with the deployment and/or retraction of the helically wound structure 210, taking into account the elastic deformation and/or plastic deformation of the helically wound structure 210.

Figure 3:
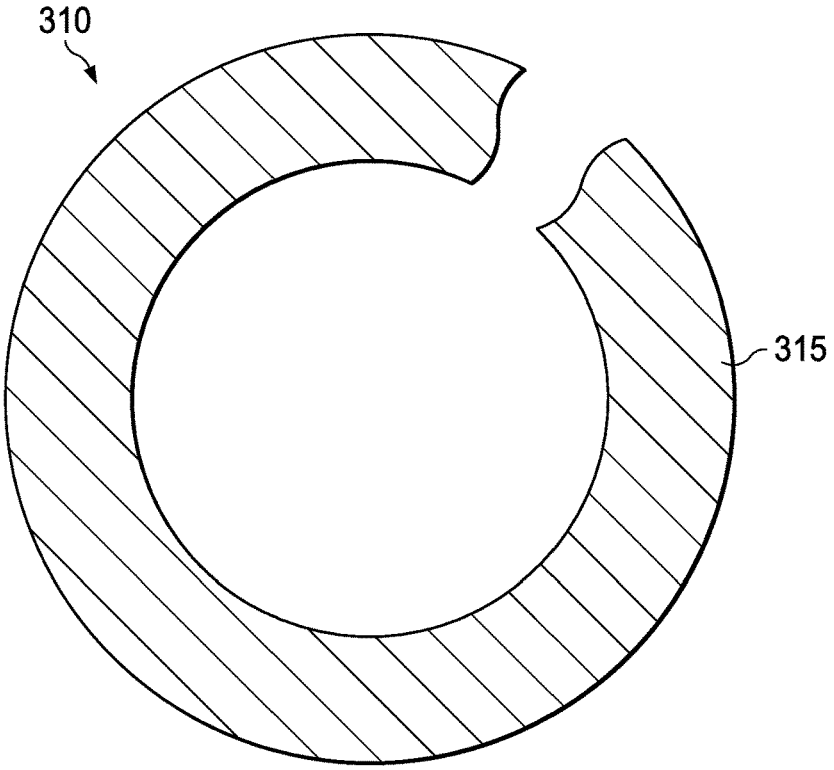
FIGS. 3 and 4 illustrate partial cross-sections of various embodiments of a helically wound structure as might be used in a downhole tool designed and manufactured according to the disclosure.

FIG. 3 illustrates a partial cross-section of one embodiment of a helically wound structure 310 as might be used in a downhole tool designed and manufactured according to the disclosure. For example, the helically wound structure 310 might find use in the downhole tool 200 illustrated in FIGS. 2A and 2B. The helically wound structure 310 illustrated in FIG. 3 comprises a solid coil 315, and, in one or more embodiments, the solid coil 315 can be flexible. In one or more embodiments, the helically wound structure 310 does not include an internal pathway for fluid to traverse. Further, the helically wound structure 310 can be operable as a downhole anchor, downhole centralizer, or downhole packer. In one example, the solid coil 315 is a flexible solid metal coil that allows the helically wound structure 310 to tightly engage the wellbore wall, and thus provide the requisite amount of force and/or friction to function as the downhole anchor and/or downhole centralizer. In yet another example, the solid coil 315 is a solid metal coil having a flexible (e.g., elastomeric) coating therein, which can function as a downhole packer. In this embodiment, flexible materials such as natural rubber, nitrile rubber, Viton® (comprising a synthetic rubber and fluoropolymer elastomer), hydrogenated nitrile butadiene rubber (HNBR), among others, could be used for the coating. In yet another example, the solid coil 315 is a solid elastomeric coil.

Figure 4:
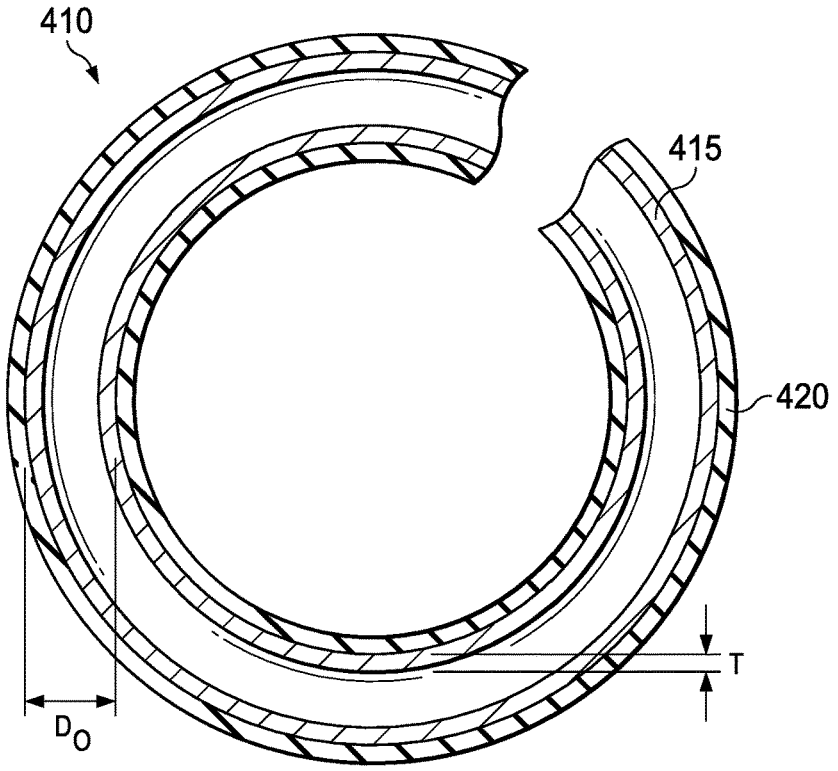

FIG. 4 illustrates a partial cross-section of one or more embodiments of a helically wound structure 410 as might be used in a downhole tool designed and manufactured according to the disclosure. For example, the helically wound structure 410 might find use in the downhole tool 200 illustrated in FIGS. 2A and 2B. The helically wound structure 410 illustrated in FIG. 4 comprises a hollow tube 415. The hollow tube 415 can allow fluid (e.g., a gas, a liquid, or a combination of a gas and liquid) to traverse within the interior of the helically wound structure 410. In one or more embodiments, the hollow tube 415 is a hollow metal tube, such as autoclave tubing. For example, the hollow tube 415 can be a hollow metal tube be capable of withstanding at least about 2,000 PSI collapse pressure. In another example, the hollow tube 415 can be a hollow metal tube capable of withstanding at least about 8,000 PSI collapse pressure or at least about 10,000 PSI collapse pressure. The hollow tube 415 can have an outside diameter ($D_O$) less than 25 mm (e.g., less than approximately 1 inch), and in certain embodiments less than 1 mm (e.g., approximately 0.04 inches). The hollow tube 415 can have a tubing wall thickness (T) of less than 10 mm (e.g., approximately 0.4 inches), and in certain embodiments less than 1.25 mm (e.g., approximately 0.05 inches). In yet another example, the hollow tube 415 might be 20,000 psi rated, have an outside diameter ($D_O$) of approximately 6.35 mm (e.g., approximately 0.25 inches), and a tubing wall thickness (T) of approximately 1.78 mm (e.g., approximately 0.07 inches), or alternatively have an outside diameter ($D_O$) of approximately 25.4 mm (e.g., approximately 1 inch) and a tubing wall thickness (T) of approximately 5.56 mm (e.g., approximately 0.22 inches). In yet another example, the hollow tube 415 might have an outside diameter ($D_O$) or inside diameter ($D_I$) that varies (e.g., steps up or steps down) along a length of the helically wound structure 410. Such variation may help to facilitate even flow along the hollow tube 415, particularly when the hollow tube 415 has one or more fluid sampling ports, as discussed in detail below.

In accordance with one or more embodiments, the hollow tube 415 sets the naturally wound state of the helically wound structure 410. In the embodiment of FIG. 4, the helically wound structure 410 is in the naturally wound state when in the radially retracted state. In alternative embodiments, however, the helically wound structure 410 is in the naturally wound state when in the radially deployed state.

The helically wound structure 410 can additionally include a flexible coating 420 surrounding the hollow tube 415. The flexible coating 420 might comprise an elastomeric coating, among other coatings. The elastomeric aspect of the flexible coating 420 again allows the flexible coating 420 to tightly engage the wellbore wall, and thus provide the requisite amount of force and/or friction to function as the downhole anchor, downhole centralizer or downhole packer, among others.

Figure 5:
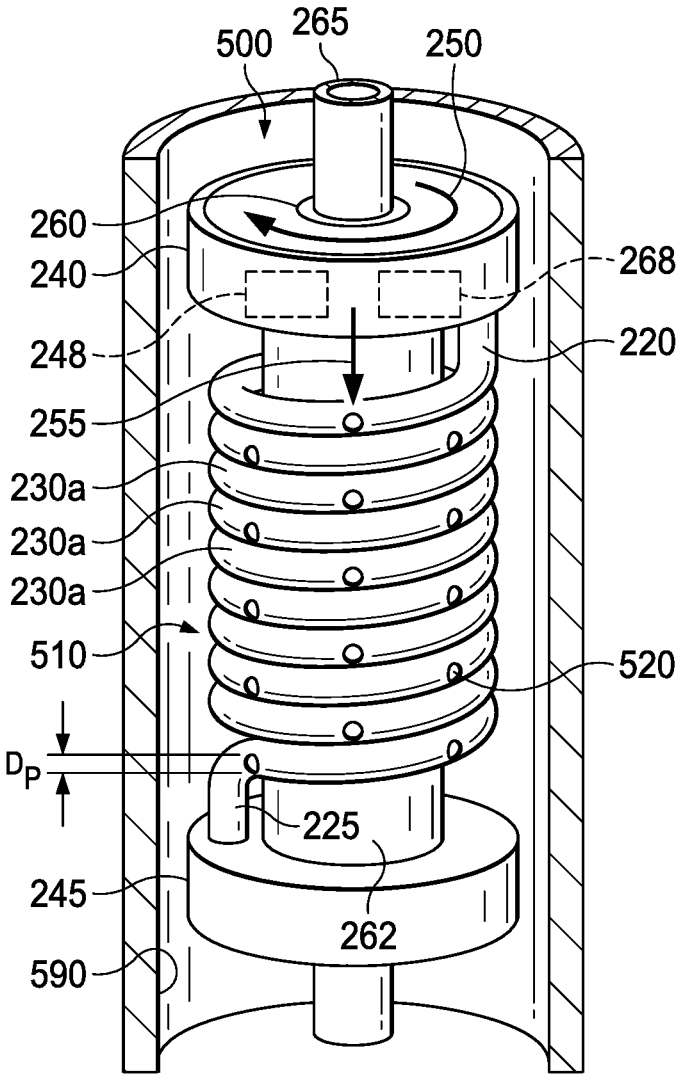
FIG. 5 illustrates a perspective view of a downhole tool designed and manufactured according to one or more embodiments of the disclosure.

FIG. 5 illustrates a perspective view of another downhole tool 500 designed and manufactured according to one or more embodiments of the disclosure. The downhole tool 500 is similar in many respects to the downhole tool 200 illustrated in FIGS. 2A and 2B. Accordingly, like reference numerals have been used to illustrate similar, if not substantially identical, features.

FIG. 5 illustrates the downhole tool 500 positioned in a radially retracted state within a wellbore wall 590. In the embodiment of FIG. 5, the wellbore wall 590 is the subterranean formation itself. Accordingly, the downhole tool 500 of FIG. 5 is configured to engage the subterranean formation, and thus could be operated as a fluid sampling tool, among others.

The downhole tool 500 of FIG. 5 includes a helically wound structure 510 having one or more fluid sampling ports 520, for example on a radially exterior wall thereof. In one or more embodiments, the fluid sampling ports 520 are able to engage the wellbore wall 590 when the helically wound structure 510 is in the radially deployed state. The one or more fluid sampling ports 520, in accordance with one or more embodiments, couple an exterior of the helically wound structure 510 (e.g., that might be in contact with the wellbore wall 590) and interior of the helically wound structure 510.

The number of fluid sampling ports 520 may vary greatly based upon the design and use of the downhole tool 500. In certain embodiments, the helically wound structure 510 could include only a single fluid sampling port 520. In another embodiment, the helically wound structure 510 could include many fluid sampling ports 520. For example, it is envisioned in one or more embodiments that the helically wound structure 510 could include three or more fluid sampling ports 520. In yet another embodiment, the helically wound structure 510 could include five or more fluid sampling ports 520, ten or more fluid sampling ports 520, and in yet another embodiment include twenty or more fluid sampling ports 520.

The fluid sampling ports 520 may also include various different positions in the helically wound structure 510. For example, in the embodiment illustrated in FIG. 5, the fluid sampling ports 520 are substantially equally spaced and positioned along a majority of a length of the helically wound structure 510. In another embodiment, not shown, the fluid sampling ports 520 might be only located in the upper coils 230*a*, and not the lower coils 230*a*, or vice versa. In another embodiment, not shown, the fluid sampling ports 520 might be only located in the central portion of the coils 230*a*, and not the upper or lower coils 230*a*, in order to maximize the distance fluid must travel between the open borehole sand face and the sampling ports. In yet other embodiments, the fluid sampling ports 520 are not equally spaced, but unequally or randomly spaced.

Similarly, the fluid sampling ports 520 may also include various different shapes and sizes in the helically wound structure 510. For example, in the embodiment illustrated in FIG. 5, the fluid sampling ports 520 are circular. In this example embodiment, the circular fluid sampling ports 520 can have a diameter ($D_P$) ranging from about 1 mm (e.g., approximately 0.04 inches) to about 10 mm (e.g., approximately 0.4 inches), among others. In another embodiment, not shown, the fluid sampling ports 520 are oval or elongated along the length of the coil. The ports may be a simple hole or may have a supportive metal shoulder to prevent the elastomer material from extruding inwards and impeding fluid flow when sampling.

While not illustrated, in certain embodiments a pressure measuring tool is coupled to the helically wound structure 210. The pressure measuring tool is not only helpful when conducting fluid samples, as discussed above with regard to FIG. 5, but is also helpful when conducting formation pressure tests, which are also within the scope of a downhole tool 500 designed, manufactured and operated according to the disclosure.

Figure 6:
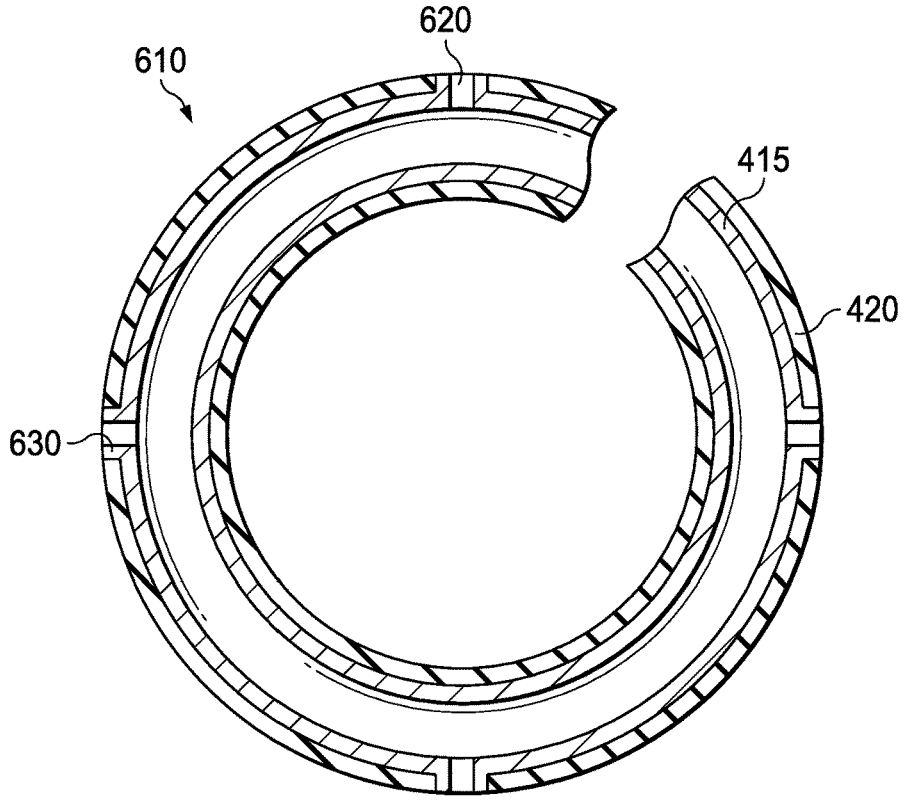
FIGS. 6 and 7 illustrate partial cross-sections of various embodiments of a helically wound structure as might be used in a downhole tool designed and manufactured according to the disclosure.

FIG. 6 illustrates a partial cross-section of a helically wound structure 610 as might be used in a downhole tool designed and manufactured according to the disclosure. For example, the helically wound structure 610 might find use in the downhole tool 500 illustrated in FIG. 5, and is similar in many respects to the helically wound structure 410 illustrated in FIG. 4. The helically wound structure 610 differs, for the most part, from the helically wound structure 410, in that it includes one or more fluid sampling ports 620. The one or more fluid sampling ports 620, in the illustrated embodiment of FIG. 6, extend through the elastomeric coating 420 and couple an exterior of the helically wound structure 610 to an interior of the hollow (e.g., metal) tube 415, and may be used for sampling fluid from the wellbore wall. As illustrated in FIG. 6, the fluid sampling ports 620 may have a supportive metal shoulder 630.

Figure 7:
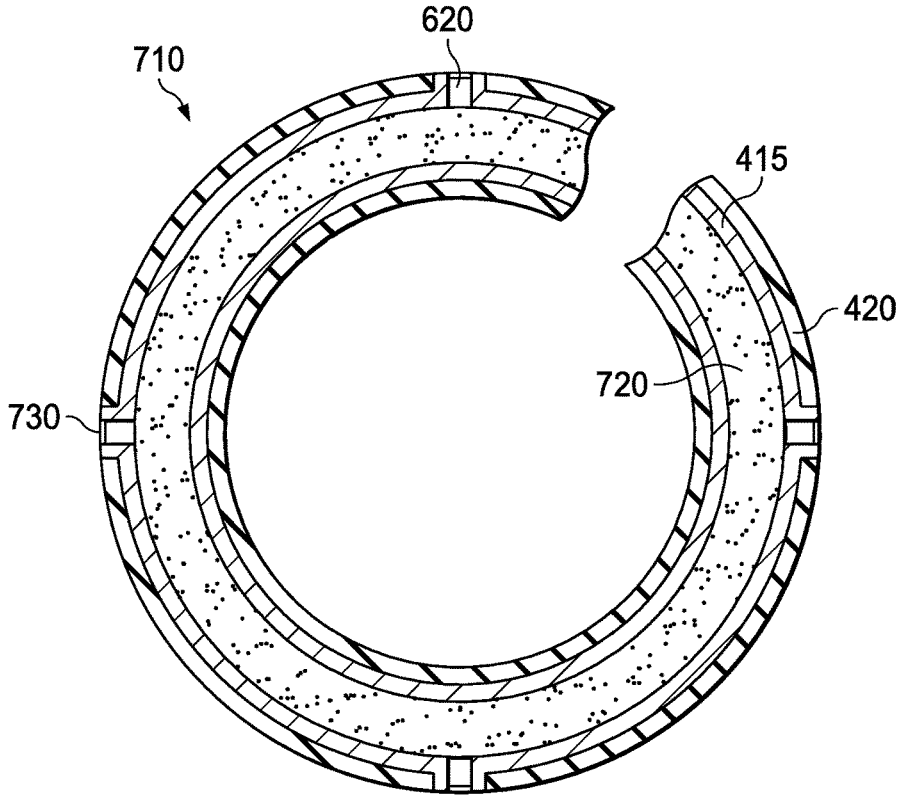

FIG. 7 illustrates a partial cross-section of another embodiment of a helically wound structure 710 as might be used in a downhole tool designed and manufactured according to the disclosure. For example, the helically wound structure 710 might find use in the downhole tool 500 illustrated in FIG. 5, and is similar in many respects to the helically wound structure 610 illustrated in FIG. 6. The helically wound structure 710 differs, for the most part, from the helically wound structure 610, in that it includes a porous material 720, such as a gravel pack material located within an interior of the hollow (e.g., metal) tube 415. The porous material 720, when used, helps keep larger scale particulate material in the subterranean formation from migrating with the sampled fluid into to the interior of the downhole tool, where it can cause valves to malfunction.

The helically wound structure 710 may additionally include one or more filter screens 730 separating the one or more fluid sampling ports 620 from the porous material 720. The filter screens 730, may provide another level of filtration for the helically wound structure 710. While the helically wound structure 710 is illustrated in FIG. 7 as including both the porous material 720 and the one or more filter screens 730, certain embodiments exist where the helically wound structure 710 only includes one or the other of the porous material 720 or one or more filter screens 730.

Figure 8:
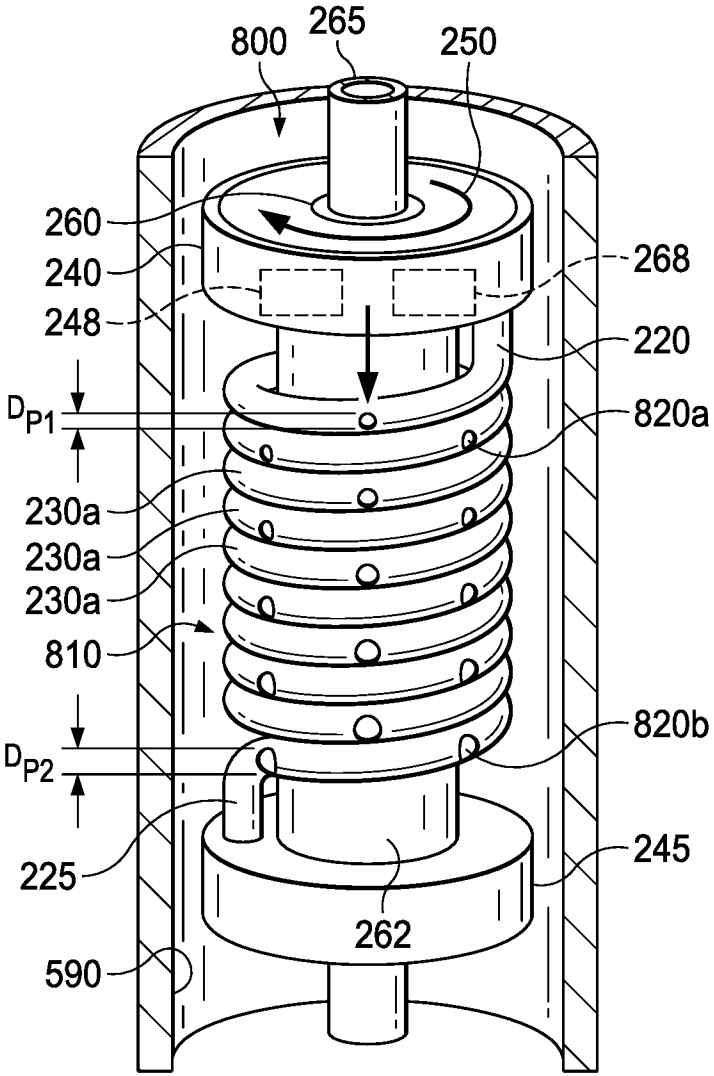

FIG. 8 illustrates a perspective view of another downhole tool 800 designed and manufactured according to one or more embodiments of the disclosure. The downhole tool 800 is similar in many respects to the downhole tool 500 illustrated in FIG. 5. Accordingly, like reference numerals have been used to illustrate similar, if not substantially identical, features. The downhole tool 800 of FIG. 8 includes a helically wound structure 810 having one or more fluid sampling ports 820, for example on a radially exterior wall thereof. In contrast to the fluid sampling ports 520 illustrated in FIG. 5, the fluid sampling ports 820 vary in size. For example, a fluid sampling port 820*a* proximate the first end 220 may be of different size than a fluid sampling port 820*b* further from the first end 220 (e.g., proximate the second end 225). In one or more embodiments, a first diameter ($D_{P1}$) of the fluid sampling port 820*a* proximate the first end 220 is less than a second diameter ($D_{P2}$) of the fluid sampling port 820*b* further from the first end 220. In the illustrated embodiment of FIG. 8, a diameter of the ports successively increase as they move from the first end 220 to the second end 225, although the opposite may also be true. Such an increase in port diameter may be used to compensate for the pressure drop that will occur in long helically wound structures 810 having a pump at one end and a plurality of fluid sampling ports 820, to produce an approximately equal pressure drop at all ports at the reservoir sand face.

Figure 9:
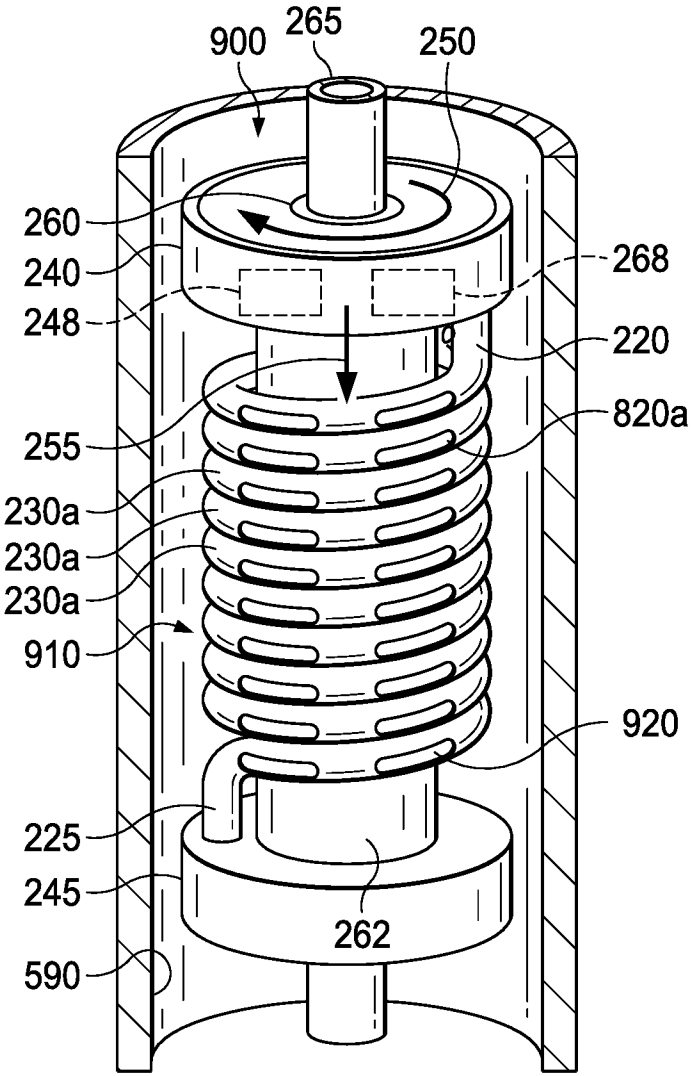
FIGS. 8-10 illustrate perspective views of other downhole tools designed and manufactured according to one or more embodiments of the disclosure.

FIG. 9 illustrates a perspective view of another downhole tool 900 designed and manufactured according to one or more embodiments of the disclosure. The downhole tool 900 is similar in many respects to the downhole tool 500 illustrated in FIG. 5. Accordingly, like reference numerals have been used to illustrate similar, if not substantially identical, features. The downhole tool 900 of FIG. 9 differs, for the most part from the downhole tool 500, in that it's helically wound structure 910 includes one or more fluid sampling ports 920 that linearly extend along a length of the helically wound structure 910.

Figure 10:
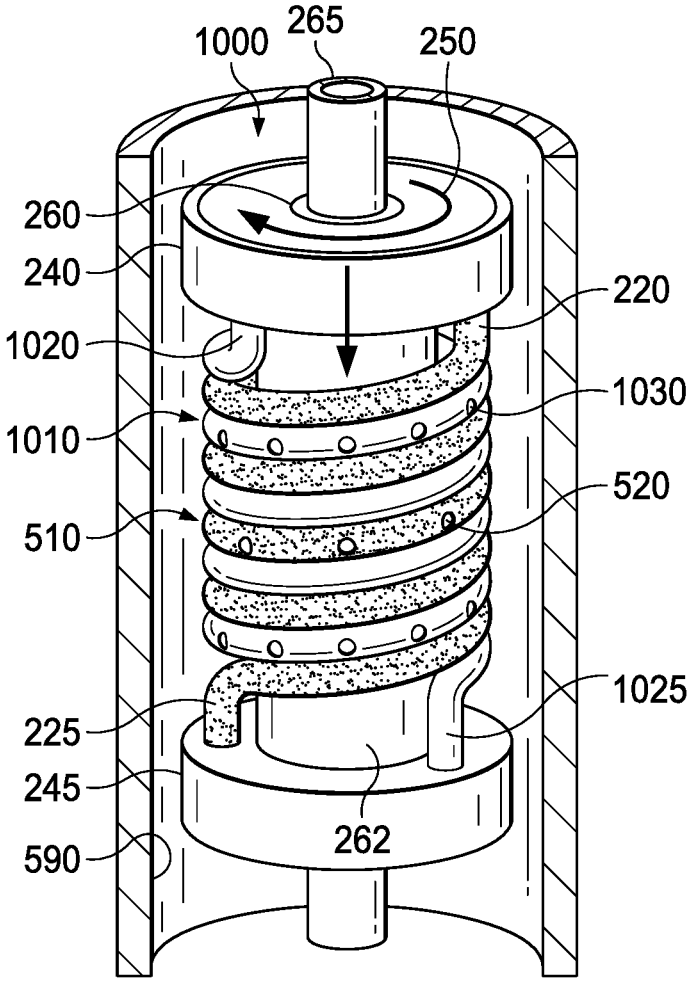

FIG. 10 illustrates a perspective view of yet another downhole tool 1000 designed and manufactured according to one or more embodiments of the disclosure. The downhole tool 1000 is similar in many respects to the downhole tool 500 illustrated in FIG. 5. Accordingly, like reference numerals have been used to illustrate similar, if not substantially identical, features. The downhole tool 1000 of FIG. 10, in contrast to the downhole tool 500, includes a second helically wound structure 1010 that interleaves the helically wound structure 510. In the illustrated embodiment, the second helically wound structure 1010 includes third and fourth ends 1020, 1025 coupled to the first member 240 and second member 245, respectively. In accordance with this embodiment, the first and second members 240, 245 may be rotated or linearly translated with respect to each other to move the helically wound structure 510 and the second helically wound structure 1010 between a radially retracted state and a radially deployed state.

The second helically wound structure 1010 of FIG. 10 additionally includes one or more fluid sampling ports 1030 on a radially exterior wall thereof. The fluid sampling ports 1030 may be similar, or different, from the fluid sampling ports 520 located in the helically wound structure 510. In the illustrated embodiment of FIG. 10, the fluid sampling ports 520 of the helically wound structure 510 are located proximate a center of the downhole tool 1000, wherein the fluid sampling ports 1030 of the second helically wound structure 1010 are located proximate the ends of the downhole tube. Moreover, in the embodiment of FIG. 10, the fluid sampling ports 1030 surround the fluid sampling ports 520. In this embodiment, the fluid sampling ports 1030 may be used to pump, capture and discard sampled fluid from closer to the upper and lower edges of the sampling apparatus, where filtrate fluid from the unsealed section of the borehole has a shorter travel path to migrate towards the sampling ports, thus providing a less contaminated fluid sample at the fluid sampling ports 520 closer to the center of the apparatus. In accordance with this embodiment, the fluid captured from the fluid sampling ports 1030 is discarded, wherein fluid captured from the fluid sampling ports 520 is routed to a fluid sampling chamber for further testing. Such an arrangement can result in a more focused, or less contaminated, sample.

Aspects disclosed herein include:

A. A downhole tool, the downhole tool including a helically wound structure having first and second ends, and a first member coupled to the first end and a second member coupled to the second end, wherein the first and second members are rotatable or linearly translatable with respect to each other to move the helically wound structure between a radially retracted state having at least one coil and a radially deployed state.

B. A method for setting a downhole tool, the method including: 1) deploying a downhole tool within a wellbore using a downhole conveyance, the downhole tool including a) a helically wound structure having first and second ends, and b) a first member coupled to the first end and a second member coupled to the second end, the first and second members positioned with respect to one another such that the helically wound structure is in a radially retracted state having at least one coil; and 2) rotating or translating the first and second members with respect to each other in a first direction to move the helically wound structure from the radially retracted state to a radially deployed state in contact with a wellbore wall.

C. A well system, the well system including: 1) a wellbore extending through various subterranean formations; and 2) a tool string positioned within the wellbore using a downhole conveyance, the tool string including; a) a telemetry sub, and b) a fluid sampling tool coupled to the telemetry sub, the fluid sampling tool including; i) a helically wound structure having first and second ends, the helically wound structure comprising a hollow tube having an elastomeric coating thereon and one or more fluid sampling ports extending through the elastomeric coating and coupling an exterior of the helically wound structure to an interior of the hollow tube, and ii) a first member coupled to the first end and a second member coupled to the second end, wherein the first and second members are rotatable or linearly translatable with respect to each other to move the helically wound structure between a radially retracted state having at least one coil and a radially deployed state.

Aspects A, B, and C may have one or more of the following additional elements in combination: Element 1: further including a mandrel, the at least one coil helically wound around the mandrel. Element 2: wherein the mandrel is a hollow mandrel configured to accept fluid and/or electrical lines there through. Element 3: wherein the helically wound structure comprises a solid coil operable as a downhole anchor, downhole centralizer, or downhole packer. Element 4: wherein the helically wound structure comprises a hollow tube having an elastomeric coating thereon. Element 5: wherein the hollow tube is a hollow metal tube having an outside diameter less than 25 mm Element 6: further including one or more fluid sampling ports extending through the elastomeric coating and coupling an exterior of the helically wound structure to an interior of the hollow tube. Element 7: further including porous material located within the interior of the hollow tube. Element 8: further including one or more filter screens separating the one or more fluid sampling ports from the porous material. Element 9: further including three or more fluid sampling ports extending through the elastomeric coating and coupling an exterior of the helically wound structure to an interior of the hollow tube. Element 10: wherein the three or more fluid sampling ports are substantially equally spaced fluid sampling ports. Element 11: wherein a first diameter ($D_{P1}$) of a first fluid sampling port proximate the first end is less than a second diameter ($D_{P2}$) of a second fluid sampling port further from the first end. Element 12: wherein the first member includes a rotary seal, the rotary seal allowing the first member to rotate relative to a non-rotating downhole conveyance. Element 13: wherein the helically wound structure is a first helically wound structure, and further including a second helically wound structure including third and fourth ends, the first member coupled to the third end and the second member coupled to the fourth end, and further wherein the at least one coil of the first helically wound structure interleave at least one coil of the second helically wound structure. Element 14: wherein the first member is an uphole member and the second member is a downhole member, and further wherein rotating or translating the first and second members with respect to each other in the first direction includes rotating the uphole member in the first direction using a motor while the downhole member is rotationally fixed within the wellbore. Element 15: wherein rotating or translating the first and second members with respect to each other in the first direction to move the helically wound structure from the radially retracted state to the radially deployed state in contact with the wellbore wall includes setting a downhole anchor within the wellbore or setting a downhole packer within the wellbore. Element 16: wherein the helically wound structure comprises a hollow tube having an elastomeric coating thereon and one or more fluid sampling ports extending through the elastomeric coating from an exterior of the helically wound structure to an interior of the hollow tube, and further including sampling fluid from the wellbore wall using the one or more fluid sampling ports. Element 17: further including rotating or translating the first and second members with respect to each other in a second opposite direction to move the helically wound structure from the radially deployed state back to the radially retracted state, and then moving the downhole tool uphole or downhole within the wellbore.

What is claimed is:

1. A downhole tool for use in a wellbore, comprising:

a helically wound structure having first and second ends, the helically wound structure comprises a hollow tube having one or more fluid ports extending through a sidewall thereof; and a first member coupled to the first end and a second member coupled to the second end, wherein the first and second members are rotatable or linearly translatable with respect to each other to move the helically wound structure between a radially retracted state having at least one coil and a radially deployed state.

2. The downhole tool as recited in claim 1, further including a mandrel, the at least one coil helically wound around the mandrel.

3. The downhole tool as recited in claim 2, wherein the mandrel is a hollow mandrel configured to accept fluid and/or electrical lines there through.

4. The downhole tool as recited in claim 1, wherein the helically wound structure comprises a solid coil operable as a downhole anchor, downhole centralizer, or downhole packer.

5. The downhole tool as recited in claim 1, wherein the helically wound structure comprises a hollow tube having an elastomeric coating thereon.

6. The downhole tool as recited in claim 5, wherein the hollow tube is a hollow metal tube having an outside diameter less than 25 mm.

7. The downhole tool as recited in claim 5, further including one or more second fluid ports extending through the elastomeric coating and coupling an exterior of the helically wound structure to an interior of the hollow tube through the one or more fluid ports.

8. The downhole tool as recited in claim 7, further including porous material located within the interior of the hollow tube.

9. The downhole tool as recited in claim 8, further including one or more filter screens separating the one or more fluid ports from the porous material.

10. The downhole tool as recited in claim 7, further including three or more fluid ports extending through the elastomeric coating and coupling an exterior of the helically wound structure to an interior of the hollow tube.

11. The downhole tool as recited in claim 10, wherein the three or more fluid sampling ports are substantially equally spaced fluid ports.

12. The downhole tool as recited in claim 10, wherein a first diameter ($D_{P1}$) of a first fluid sampling port proximate the first end is less than a second diameter ($D_{P2}$) of a second fluid sampling port further from the first end.

13. The downhole tool as recited in claim 5, wherein the first member includes a rotary seal, the rotary seal allowing the first member to rotate relative to a non-rotating downhole conveyance.

14. The downhole tool as recited in claim 1, wherein the helically wound structure is a first helically wound structure, and further including a second helically wound structure including third and fourth ends, the first member coupled to the third end and the second member coupled to the fourth end, and further wherein the at least one coil of the first helically wound structure interleave at least one coil of the second helically wound structure.

15. A method for setting a downhole tool, comprising:

deploying a downhole tool within a wellbore using a downhole conveyance, the downhole tool including:

a helically wound structure having first and second ends, the helically wound structure comprises a hollow tube having one or more fluid ports extending through a sidewall thereof; and a first member coupled to the first end and a second member coupled to the second end, the first and second members positioned with respect to one another such that the helically wound structure is in a radially retracted state having at least one coil; and rotating or translating the first and second members with respect to each other in a first direction to move the helically wound structure from the radially retracted state to a radially deployed state in contact with a wellbore wall.

16. The method as recited in claim 15, wherein the first member is an uphole member and the second member is a downhole member, and further wherein rotating or translating the first and second members with respect to each other in the first direction includes rotating the uphole member in the first direction using a motor while the downhole member is rotationally fixed within the wellbore.

17. The method as recited in claim 15, wherein rotating or translating the first and second members with respect to each other in the first direction to move the helically wound structure from the radially retracted state to the radially deployed state in contact with the wellbore wall includes setting a downhole anchor within the wellbore or setting a downhole packer within the wellbore.

18. The method as recited in claim 15 wherein the helically wound structure comprises a hollow tube having an elastomeric coating thereon and one or more second fluid ports extending through the elastomeric coating from an exterior of the helically wound structure to an interior of the hollow tube, and further including sampling fluid from the wellbore wall using the one or more fluid sampling ports.

19. The method as recited in claim 15, further including rotating or translating the first and second members with respect to each other in a second opposite direction to move the helically wound structure from the radially deployed state back to the radially retracted state, and then moving the downhole tool uphole or downhole within the wellbore.

20. A well system, comprising:

a wellbore extending through various subterranean formations; and a tool string positioned within the wellbore using a downhole conveyance, the tool string including:

a telemetry sub; and a tool coupled to the telemetry sub, the tool including;

a helically wound structure having first and second ends, the helically wound structure comprising a hollow tube having an elastomeric coating thereon and one or more fluid ports extending through the elastomeric coating and coupling an exterior of the helically wound structure to an interior of the hollow tube; and a first member coupled to the first end and a second member coupled to the second end, wherein the first and second members are rotatable or linearly translatable with respect to each other to move the helically wound structure between a radially retracted state having at least one coil and a radially deployed state.

* * * * *